US005085119A

United States Patent [19]

Cole

[11] Patent Number: 5,085,119

[45] Date of Patent: Feb. 4, 1992

[54] GUITAR-STYLE SYNTHESIZER-CONTROLLERS

[76] Inventor: John F. Cole, 4 Ilford Close, Luton, Bedfordshire, England

[21] Appl. No.: 554,409

[22] Filed: Jul. 19, 1990

[30] Foreign Application Priority Data

Jul. 21, 1989 [GB] United Kingdom ..... 8917005

[51] Int. Cl.[5] ..... G10H 3/06; G10H 3/14; G10H 1/02

[52] U.S. Cl. ..... 84/724; 84/725; 84/730; 84/739; 84/DIG. 30

[58] Field of Search ..... 84/615, 626, 627, 629, 84/644–647, 653, 662, 663, 670, 722, 723, 737, 738, 742, 743, 739, 727, DIG. 30, 724, 725, 730

[56] References Cited

U.S. PATENT DOCUMENTS

| | | | |
|---|---|---|---|
| Re. 31,019 | 8/1982 | Evangelista | 84/702 |
| 3,555,166 | 1/1971 | Gasser . | |
| 4,177,705 | 12/1979 | Evangelista . | |
| 4,245,540 | 1/1981 | Groupp | 84/738 |
| 4,336,734 | 6/1982 | Polson | 84/646 |
| 4,339,979 | 7/1982 | Norman | 84/646 X |
| 4,372,187 | 2/1983 | Berg | 84/722 |
| 4,702,141 | 10/1987 | Bonnano | 84/646 X |
| 4,961,363 | 10/1990 | Mizuno et al. | 84/615 |
| 4,986,157 | 1/1991 | Matsubara | 84/646 |

FOREIGN PATENT DOCUMENTS

| | | |
|---|---|---|
| 1282364 | 7/1972 | United Kingdom . |
| 2078427 | 1/1982 | United Kingdom . |

*Primary Examiner*—William M. Shoop, Jr
*Assistant Examiner*—Jeffrey W. Donels
*Attorney, Agent, or Firm*—Young & Thompson

[57] ABSTRACT

An instrument is structured as a guitar and control-box incorporating electronic circuitry to control an external electronic synthesizer and electronic sampling instruments via a conventional M.I.D.I. system. The instrument is played in the fashion of a guitar with digital signals generated in response to switches activated when a musician plays the instrument in a similar manner to playing a conventional guitar. Boards which are capable of movement with respect to the guitar body or arm together with displacement transducers and high efficiency touch-sensitive switches are used for note selection and to create pitch-bend, note-velocity and tremolo signals. The note and fret touch switches are mounted on fret boards which replace the strings of a conventional guitar. The fret boards also produce pitch bend signals.

A plurality of pluckboards initiate note-pluck and enable ergonomic multi-timbre playing.

19 Claims, 6 Drawing Sheets

GUITAR-STYLE SYNTHESIZER-CONTROLLERS

FIELD OF THE INVENTION

This invention relates to guitar-style synthesizer-controllers and more specifically to electronic instruments that synthesize musical tones or control musical synthesizers via a M.I.D.I. (Musical Instrument Digital Interface) or similar parallel or series interface. It provides such a musical instrument which may be embodied either as a monophonic device or as a polyphonic device capable of producing multi-timbre chords or notes and pitch bend actions simulating the performance of a guitar.

In a conventional guitar tones are generated by plucking or strumming one or more of a plurality of strings. The tones produced are amplified by the sound box of traditional acoustic guitars and, in electric guitars, by an electronic amplifier which is fed by electrical audio frequency signals from magnetic pickups adjacent to the strings. Synthesizers have been mainly the domain of keyboard players. Although guitar synthesizers have been available, they have been generally unsuccessful.

There are three main reasons for this:

1. Most manufacturers have merely converted the electrical guitar signal of a conventional electrical guitar to a digital signal to be fed to synthesizers via a M.I.D.I. This method introduces time delay problems that make it impossible for many types of music to be played.

2. A piano-style keyboard player can assign separate voices to different synthesizer keyboards or areas of a synthesizer keyboard, allowing multi-timbre play, which has resulted in the popularity of keyboard synthesizers.

3. Guitarists require "pitch bend" and this has not been available to any satisfactory degree. Also, effective pitch bend is essential for most guitarists to express themselves. Pitch bend has been generally ineffective, again due to processing time delays. A digital-guitar synthesizer-controller with effective pitch bend would give guitar players an advantage over piano style keyboard players when using synthesizers, because pitch bend is difficult to control on a piano keyboard. Various switching mechanisms have been used to select notes on digital guitars but they have not enabled effective pitch bend.

Touch-sensitive switches have been tried on guitar synthesizer-controllers but have been either very expensive or unreliable. Cost is important as there are 132 notes on a normal guitar. With high quality M.I.D.I. synthesizers and samplers becoming cheaper, the need for an effective high speed digital-guitar synthesizer-controller has become urgent. UK patent specification GB2078427A discloses the use of touch-sensitive switches located on the neck of a guitar. However, because of the low switch voltage, the unit is unreliable, especially when used by a musician with a dry skin. Moreover, wet hands can cause malfunction. The voltage cannot be increased to a value above the supply voltage (Vdd) of the integrated circuit, to increase sensitivity, without risking damage to the integrated circuit. The unit does not have pitch bend facilities or allow for ergonomic multi-timbre playing. The desirability of increasing the sensitivity of the touch switches is appreciated, but the prior art does not indicate how to achieve this.

Attempts have also been made by digital guitar manufacturers to include realistic "hammer-on" in the design of their instruments, with little success. Hammer-on is the term used in the musical industry for the action of a guitarist whilst playing a conventional guitar, plucking a note on a string and playing several extra notes before the pluck decays, without replucking. "Slide" is similar to hammer-on, but applies to the playing of a series of directly ascending or descending notes.

Attempts, with little success, have also been made to achieve "open string pull-off" for digital guitars. This occurs when a guitarist, whilst playing a conventional guitar, plucks a string and after playing one or more notes on a single pluck, releases the string to play the open or free string note.

SUMMARY OF THE INVENTION

It is an object of the present invention to provide a guitar-style synthesizer-controller which overcomes or at least substantially reduces the above-mentioned drawbacks.

In accordance with the invention there is provided a guitar-type synthesizer-controller comprising a body having a playing face with a pluck or strum region having an array of individual pluck-sensitive means usable analogously to string selection, an arm attached to the body and carrying a plurality of elongate lines of frets spaced alternately with note-selection means, and switch means between each of said pluck-sensitive means, said frets and said note-selection means and an interface which is arranged to produce digital output signals, wherein the frets and note-selection means are resiliently displaceable in at least one direction and displacement sensing means are associated therewith to provide output signals representative of such movement.

Thus, the synthesizer controller can be held and played in the manner of a conventional guitar, providing a musical instrument having the appearance and characteristics of a guitar so that one familiar with the technique of playing an electric guitar can readily adapt to the instrument of this invention. However sounds or audio signals are not normally produced by this instrument and the instrument does not normally have strings. Digital signals are produced which can then be scanned and transmitted to electronic synthesizers and electronic samplers via a conventional M.I.D.I.

Among the preferred features of the instrument of the invention are the following:

1. The means to produce digital output signals may comprise fret note-selection means and/or pluck string-selection means, which may comprise touch-sensitive switches. These touch-sensitive switches advantageously comprise a CMOS gate circuit in which a zener diode protects the CMOS, the zener voltage being lower than the supply voltage of the circuit between the input and Vss (supply ground). This allows a higher switch voltage to be employed, which results in greater switch sensitivity, which is adjustable if the voltage is adjustable. A logic gate is usually used for every fret note position.

2. The fret note-selection means and/or pluck string-selection means may be supported by elongate rigid members or boards, each of which is resiliently movable in at least one direction. One or more displacement sensors may be associated with the or each direction for each fret board and/or pluck board so as to provide an output signal dependent upon fret board and/or pluck board movement. By these means pitch bend, or velocity for the pluck board, can be selected and controlled. If the boards have two or more degrees of freedom, further functions can be selected and controlled similarly. Such displacement sensors could similarly be used with other controls, for example a tremolo effect control mechanism or mechanisms.

3. The guitar-style synthesizer-controller advantageously includes means to select timbre, which may be provided by means on the body of the guitar, preferably the pluck string-selection means themselves. Further advantageously, these comprise a column of pluck-sensitive means, which may be mounted on a board as described under point 2 above. Each timbre is preferably a different musical instrument. An array of pluck-sensitive means may be provided across the instrument body to allow for a multitude of possible timbres. The output signal(s) from the pluck-sensitive means is scanned and transmitted to the M.I.D.I. for synthesizing. More than one timbre can be selected to play together simultaneously.

4. The pluck-sensitive means may comprise touch-sensitive means, electromagnetic-radiation-sensitive means, typically light-sensitive means, or magneto-sensitive means.

5. Means for selecting a tremolo effect may be provided, which is preferably additive to any other selected effect.

6. Means to select sustainment of any selected effect may be provided.

7. Means to selectively memorize for a selected time any selected combination of selected effects may be provided.

In a preferred embodiment notes are selected by touch-sensitive switches between fret bars which are laid out in a similar way to a conventional guitar to provide 21 frets, but with 6 separate, parallel, elongate lines of fret boards, each line representing a string of a conventional fret board. Each fret board includes a column of note-selection switches. The fret bars themselves can be touch-sensitive switches, enabling them to be assigned to note dampen or note mute. The touch-sensitive switches used on the instrument all have a high efficiency compared with previous touch-sensitive switch designs. This is achieved by using a higher switch voltage than the Vdd (supply voltage) of the CMOS (complementary metal oxide semiconductor) integrated circuits. The higher voltage is required to overcome the skin resistance of the guitarist.

The voltage can be adjustable, enabling adjustable sensitivity. The integrated circuit is prevented from suffering input overvoltage by connecting a zener diode with a zener voltage lower than the Vdd of the integrated circuit between the input and Vss (supply ground). Extra sensitivity can also be increased by using a pulsating switch voltage, making the switch partly conductive and partly capacitive. Tri-state output CMOS integrated circuits may be used, acting as a combined touch-sensitive switch and scanner input circuit, resulting in a large saving in components.

The note switches and fret bars are mounted or etched on to the rigid fret boards and may be chrome plated or anodised. There are 6 fret boards, each representing part of a string of a conventional guitar. Each fret board is secured on to the arm of the guitar by adhesive, bolts, screws or within a mounting bezel, brackets or extrusions, which are rigidly mounted to the arm of the guitar. A flexible rubber (or similar) gasket is assembled between the board and the instrument arm, allowing movement of the fret board with respect to the arm. Each fret board can move on three mutually perpendicular axes with respect to the arm of the instrument. A plurality of displacement sensors detects displacement on any axis or combination of axes. The displacement signal is converted to a digital signal and transmitted via the M.I.D.I. Where a plurality of sensors is located along the length of a fret board to measure displacement on the same axis, the sensor with the largest signal at any instant will be automatically selected.

A touch switch or conventional switch may be included to selectively reverse the scanning order of the fret boards without reversing the note order. This makes the instrument suitable for left hand play.

A plurality of pluck boards is mounted in the area of the instrument corresponding to the soundbox of an acoustic guitar, where notes are plucked. Each pluck board has 6 touch-sensitive switches etched on to it or assembled on to it, each one representing a string of a conventional guitar. Each touch-sensitive switch can be assigned to an individual timbre enabling effective ergonomic multi-timbre playing. Each pluck board is assembled to the body of the instrument in a similar way to the fret boards. They do not however have flexible rubber bonded to them. Instead, they are held to the body of the instrument by bezels or brackets which allow movement. Springs are used to create a reaction to movement and to return the board to its normal position. A note is plucked when a fret board touch-sensitive switch is released by the guitarist's finger or an electrically-conductive plectrum. The action of the guitarist moves the pluck board before the pluck is actioned by releasing it. The further the guitarist moves the pluck board from its normal position the stronger the pluck. This action mimics the action of a guitarist plucking a note on a conventional guitar. The unit could be set up to play a different timbre on reverse pluck to that played on forward pluck. The conductive plectrum can be connected to the switch voltage via a connecting wire, connected to a terminal on the instrument body. Alternatively a conductive bracelet could be connected in the same way, if finger plucking is preferred. A displacement sensor is mounted adjacent to each pluck board. The displacement signal, measured as a note is plucked, is converted to a digital signal and transmitted via the M.I.D.I. The signal will normally be assigned to attack or velocity, but switches are provided to assign it to any function.

Hammer-on and slide are provided by differentiators or integrators in the pluck processing circuitry, providing a sustaining effect. The rate of sustainment is adjustable using touch switches. The same circuitry enables effective open string pull-off, when open string play is selected. Open string play is selected by function switches. The open string play select switch can either be a conventional switch or a touch-sensitive switch.

BRIEF DESCRIPTION OF THE DRAWINGS

Embodiments of the invention will now be described by way of example, with reference to the drawings, in which.

DESCRIPTION OF THE PREFERRED EMBODIMENT

Figure 1:
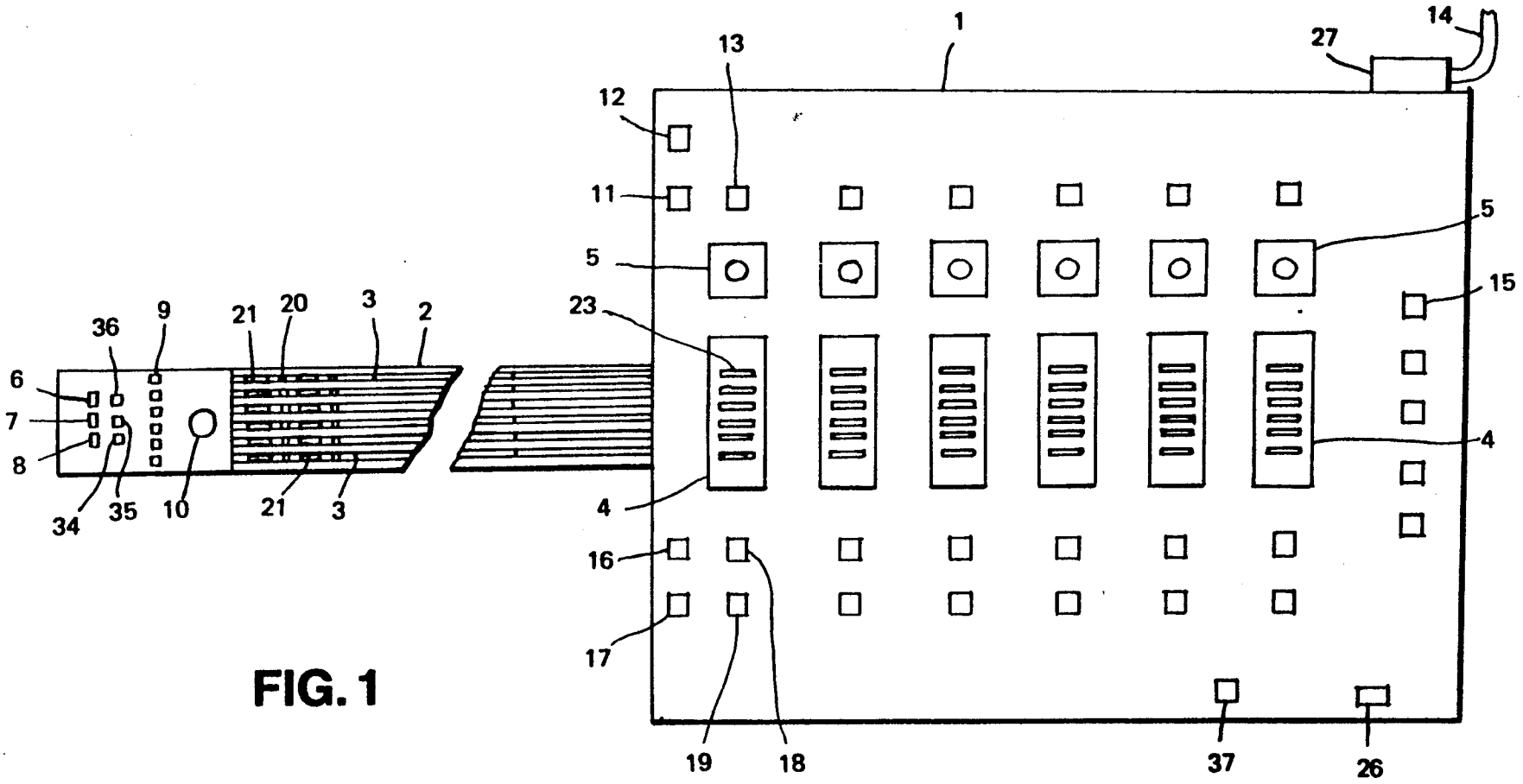
FIG. 1 is a diagrammatic representation of the face of a guitar-style synthesizer-controller according to the invention.

FIG. 1 is a plan or face view of a guitar-style synthesizer-controller of this invention showing its playing surface. The guitar-style synthesizer controller has a body 1 having a pluck or strum region and an arm 2 connected to the body. The body 1 and the arm 2 each carry an array of control switches. The arm has a total of 6×21, i.e. 126, frets. All switches shown are touch-sensitive switches, although any type of switch could be used. Elongate fret boards 3 are mounted parallel to each other and alongside each other on the guitar arm 2 (see also FIGS. 2A and 2B). The control switches of the pluck/strum region are mounted on pluck boards 4. Each pluck board switch, on each pluck board, can be set up with distinct timbres which can be played simultaneously by plucking the appropriate pluck board, enabling effective multitimbre playing.

Adjacent to each pluck board 4 are facilities to aid the guitarist. A tremolo board 5 is suitably placed to enable tremolo to be added to notes plucked on the adjacent pluck board (see FIG. 7), when moved from its normal position.

Hold switches 18 are provided to prevent note-off signals from being transmitted to a synthesizer or sampler via a M.I.D.I., enabling the note plucked on the adjacent pluck board 4 to be sustained after it has been released on the fret board 3. A hold switch 18 is provided for each pluck board, together with a clear switch 19. The hold switch 18 is selected before a note is released on a fret board and the note will be held until it is cleared by the appropriate clear switch 19 or until the appropriate switch on the appropriate pluck board is re-plucked, either of which initiate note-off signals. Other notes can be played using other pluck boards while this note is sustained. A master hold switch 16 holds all notes on the keyboard, whilst a master clear switch 17 clears all notes.

Combine switches combine the timbres of appropriate pluck boards 4, when combine switches are selected simultaneously. The timbres separate when a reset switch 12 is selected. A master combine switch 11 combines all timbres which are played on the pluck board nearest to the arm 2. Pitch bend sensitivity can be selected using select switches 6 (high), 7 (normal) or 8 (low) at the end of the arm 2. Touch switch sensitivity can be adjusted using a potentiometer 10 which is common to all touch switches (see FIG. 5).

Pluck sustain can be adjusted by the use of touch sensitive switches, namely low 34, normal 35, and high 36. The higher the sustain, the longer hammer-on and slide time is available. Open string play/mute switches 9 are positioned adjacent to the pluck sustain switches (see FIG. 5). If one-hand play is selected using a one-hand play switch 37, notes selected on the fret boards 3 are plucked automatically. When this function is selected the combine switches select the timbre, which is that set up on the adjacent pluck board. Patch select switches 15 enable timbres which have been previously set up on the control box to be selected during play.

A connector 27 enables a multicore cable 14 to be connected to a control box. The control box contains electronic circuitry, function switches and M.I.D.I. connectors. A function switch 26 enables the selection of left hand or right hand play. For left hand play, the scanning order of the fret boards is the reverse of that for right hand play, whilst the note order is the same. Light-emitting diodes can be located adjacent to or integral with each function switch to indicate function selection.

Figure 2C:
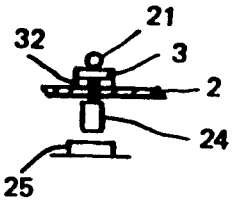
FIG. 2C. is a section taken along the line C—C of FIG. 2B.
Figure 2B:
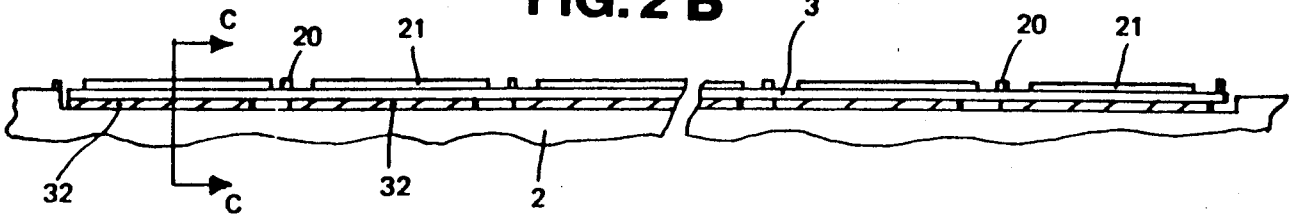
FIG. 2B is a side view of the fret board.
Figure 2A:
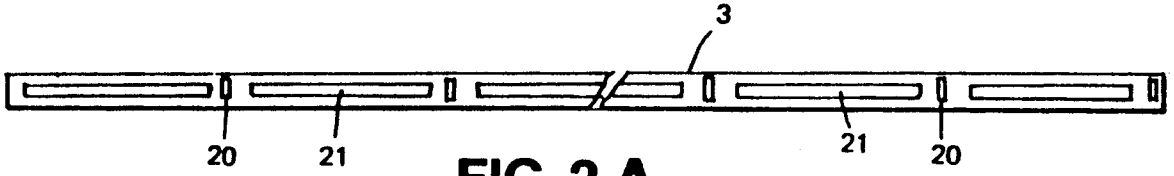
FIG. 2A is a diagrammatic front view of a fret board of the instrument of FIG. 1.

FIGS. 2A to 2C show how the elongate fret boards 3 are assembled on the instrument arm 2. Lengths of resilient material such as rubber or foam rubber 32 are sandwiched between each fret board 3 and the guitar arm 2, permitting movement of each fret board with respect to the arm 2 about three mutually perpendicular axes by virtue of the resilience of the mounting. The fret board 3 is bonded to the rubber 32 which is in turn bonded to the arm 2. A magnet 24 is attached to each fret board 3 and protrudes into the arm 2. Adjacent to each magnet is a Hall-effect transducer 25 which is mounted directly on the arm 2. The magnet and transducer form a displacement sensor to detect displacement. The magnet 24 will move with the fret board 3. The signal detected by the transducer 25, which is proportional to the fret board displacement, is converted into a digital signal and transmitted via the M.I.D.I. For the outside fret boards, where space is limited, the magnet and sensor may be mounted at an angle, to save space.

This displacement signal from the fret boards will normally be assigned to pitch bend. Each fret board 3 carries a plurality of note bars 21 and intermediate fret bars 20. The note bars 21 and the fret bars 20 are metallic and are soldered, brazed or welded to the fret board. The note bars 21 are round in transverse section and the fret bars 20 are rectangular in transverse section. They each form one contact of a respective touch-sensitive switch.

Figure 3B:
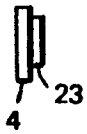
FIG. 3B is an end view of the pluck board.
Figure 3A:
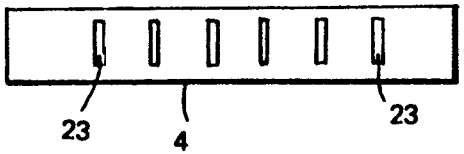
FIG. 3A is a diagrammatic front view of a pluck board of the instrument of FIG. 1.

FIG. 3 shows how each pluck board 4 has a column of pluck bars 23, which are metallic and round in transverse section and have the same spacing as conventional guitar strings. Each bar 23 forms one contact of a respective touch-sensitive switch.

Figure 4B:
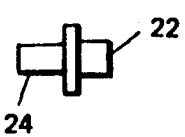
FIG. 4B is a side view of the tremolo board.
Figure 4A:
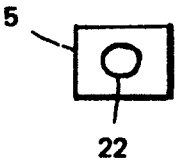
FIG. 4A is a diagrammatic front view of a tremolo board of the instrument of FIG. 1.

FIG. 4 shows the details of each tremolo board 5, which comprises an upstanding pin 22 and a magnet 24 screwed to the underside of the board.

Figure 5:
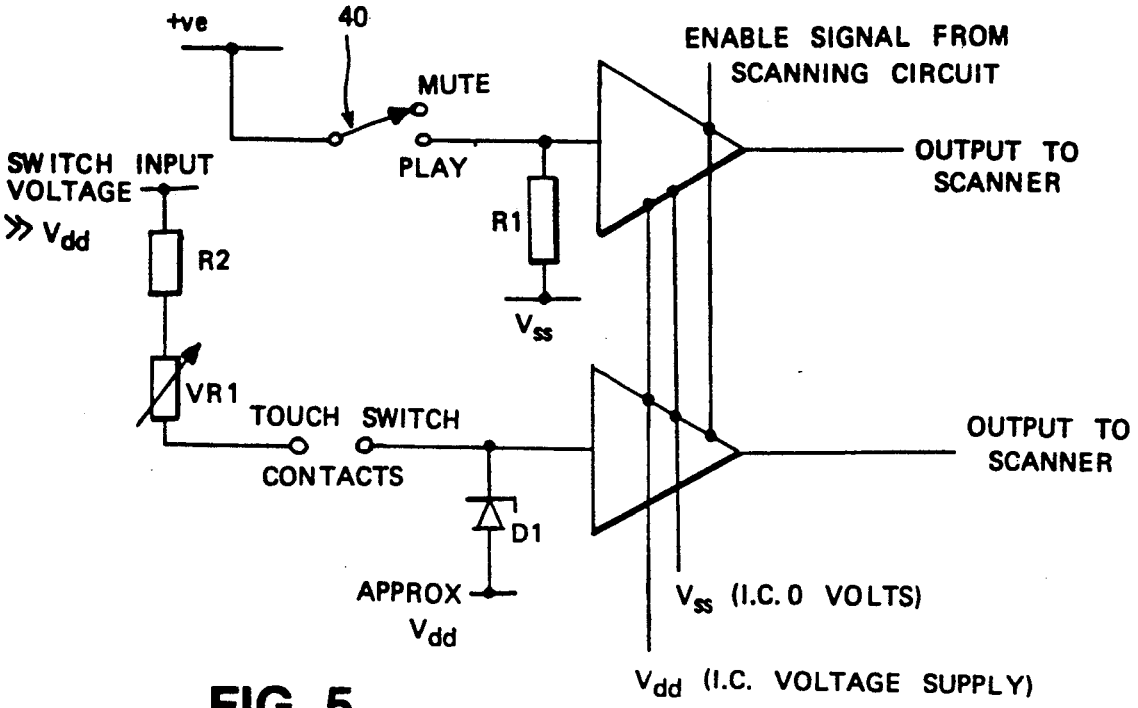
FIG. 5 is a schematic circuit diagram of a "touch switch and open string circuit" of the instrument according to the invention.

FIG. 5 illustrates the circuit diagram of an open string circuit and a touch-sensitive switch circuit for use in the instrument of the invention. They both also form the first stage scanner circuit. The open string circuit provides a choice for the guitarist. With the open string switch 40 closed, open string notes will be played as they are on conventional guitars. When the switch 40 is in the mute position, open string notes will be ignored. There are six identical open string circuits, one for each fret board 3.

All of the touch-sensitive switches are identical in this embodiment. A touch switch sensitivity potentiometer VR1 and a limiting resistor R2 are present in each touch-sensitive switch. The potentiometer voltage is applied to the guitarist by applying it to a plate on the rear of the instrument arm, via a terminal on the instrument body and a wire to a conductive plectrum or conductive bracelet. The other contact of the switch is individual to each switch and could be a note, fret, pluck or function switch contact.

A relatively high switch input voltage (higher than the integrated circuit supply voltage Vdd) increases the input sensitivity and noise immunity of the CMOS buffer. The zener diode D1 which has a zener voltage of slightly less than Vdd protects the input of the buffer from over-voltage. The buffer could alternatively be any CMOS gate with all inputs connected together, unused inputs connected to Vdd or Vss, or inputs not used for touch inputs used for strobe or enable functions.

Figure 6:
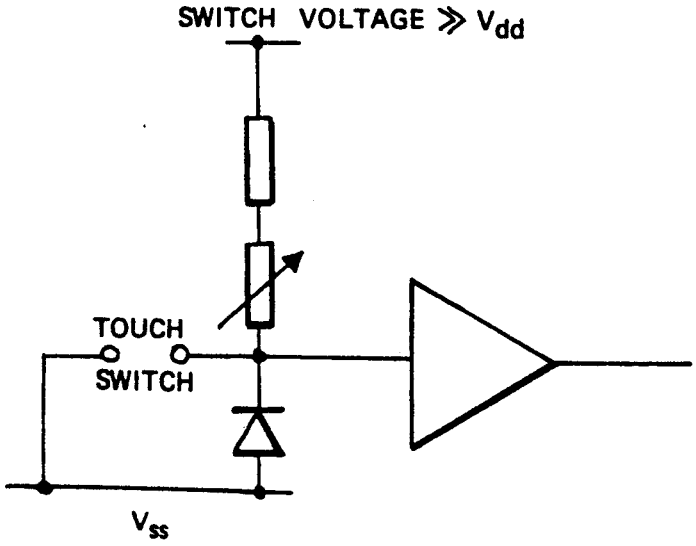
FIG. 6 shows schematically a current sink alternative to the circuit of FIG. 5.

FIG. 6 illustrates a current sink alternative to the current source touch-sensitive switch circuit of FIG. 5.

Figure 7A:
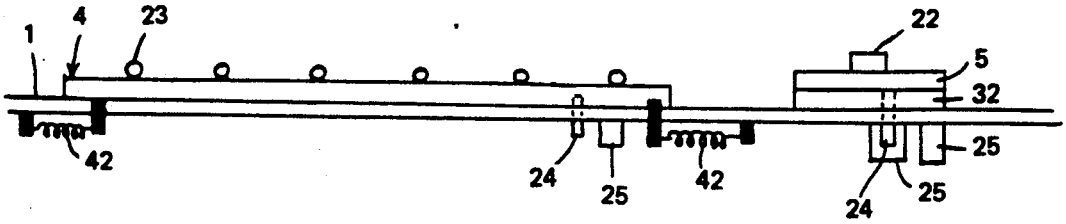
FIG. 7A is a side view of a pluck board and a tremolo board of an instrument according to the invention.
Figure 7B:
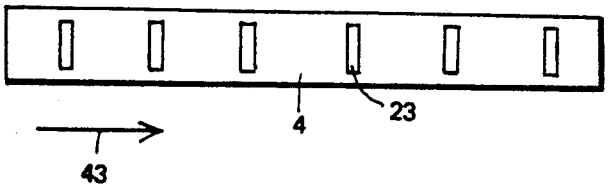
FIG. 7B is a plan view of the pluck board of FIG. 7A.
Figure 7C:
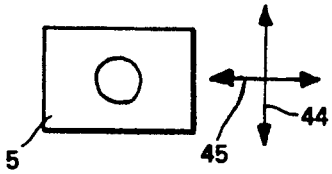
FIG. 7C is a plan view of the tremolo board of FIG. 7A.

FIG. 7A illustrates two features of the invention: namely, the pluck board assembly and the tremolo board assembly. Plan views of these parts are shown in FIGS. 7B and 7C respectively. Detailed views of the boards are shown in FIGS. 3 and 4. Each board is held to the body of the instrument by bezels or brackets which allow movement and has springs 42 to create a reaction to movement and to return the board to its normal position. The board is plucked in a similar way to strings on a conventional guitar, by plucking the appropriate touch-sensitive switch. As described above, the displacement of the pluck board is measured by a Hall effect transducer 25 which is mounted on the instrument body and a magnet 24 which is attached to the pluck board. When the pluck is released, notes selected on the symmetrically adjacent, i.e. appropriate, fret board 3 to the touch-sensitive switch plucked, are played by transmitting appropriate digital signals via the M.I.D.I. Each pluck board is displaceable lengthwise as indicated by the arrow 43 and each tremolo board 5 is mounted so as to be displaceable in two mutually perpendicular directions as indicated by arrows 44 and 45.

Pluck sustainment (the time that the pluck lasts) is dependent on differentiators in the processing circuitry and is adjustable. It enables hammer-on and slide. It is similar to the natural sustain of a conventional guitar. The displacement transducer signal is converted to a digital signal and transmitted via the M.I.D.I. The signal will normally be assigned to attack or velocity.

The tremolo board 5 is assembled in the same way as the pluck board 4. Each tremolo board has two adjacent displacement transducers 24,25 measuring displacement on two perpendicular axes, the signals being digitised and transmitted via the M.I.D.I. After a note is plucked its pitch can be increased by moving the associated tremolo board 5 away from the pluck board and decreased by moving it towards the pluck board. Movement on this axis (arrow 45) is normally assigned to provide pitch bend. Movement on the other axis (arrow 44) will normally be assigned to another function.

Figure 8:
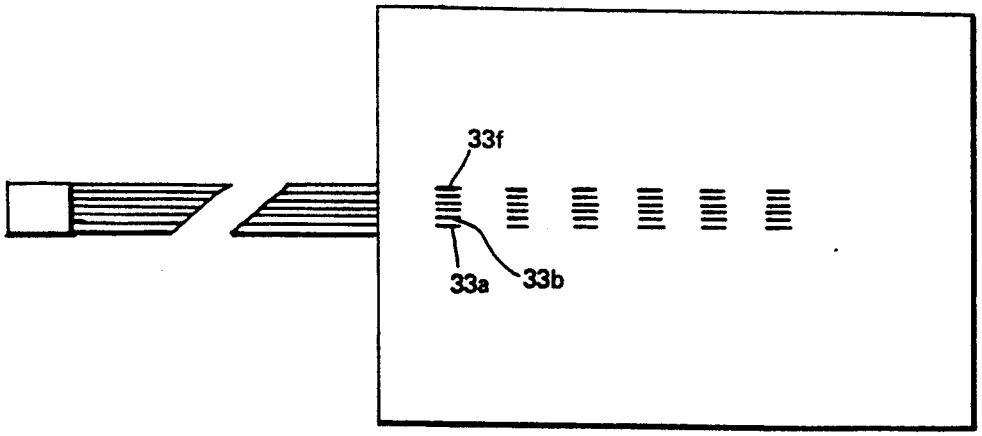
FIG. 8 shows a second type of plucking system for an instrument according to the invention.
Figure 9:
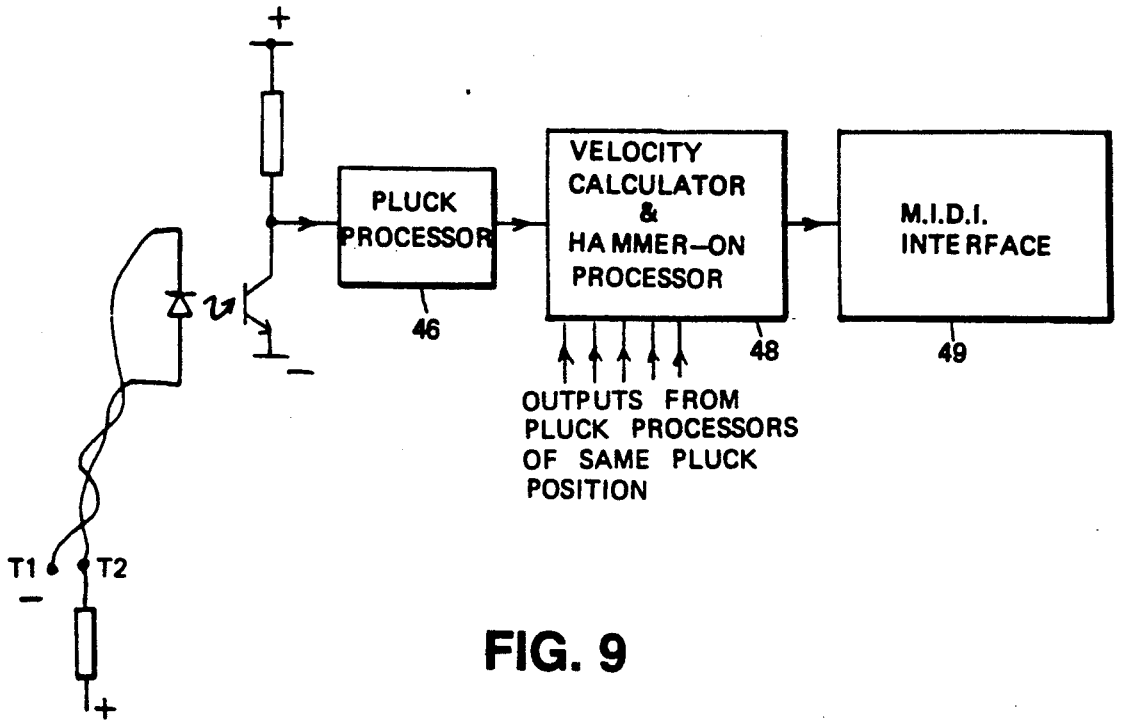
FIG. 9 shows a schematic circuit diagram for the plucking system of FIG. 8.

FIG. 8 illustrates another plucking system for use in this invention. The corresponding circuit diagram is shown in FIG. 9. Each pluck position has six phototransistor sensors or photo-diodes 33*a*, 33*b*, 33*c*, 33*d*, 33*e*, 33*f* each representing a string of a conventional guitar, laid out in a similar way as when using pluck boards. A plectrum with a light-emitting diode (or an infra-red diode for infra-red sensors) is used to activate the sensors. A velocity signal is created in processor 46 and velocity calculator and hammer-on processor 48 by calculating the time between plucks of columnarly adjacent sensors. The assignable signal is transmitted via the M.I.D.I. interface 49. The shorter the time, the higher the velocity. Alternatively diffuse scan opto switches could be used. A guitarist can then pluck notes with a finger or a photo-reflective plectrum.

Figure 10:
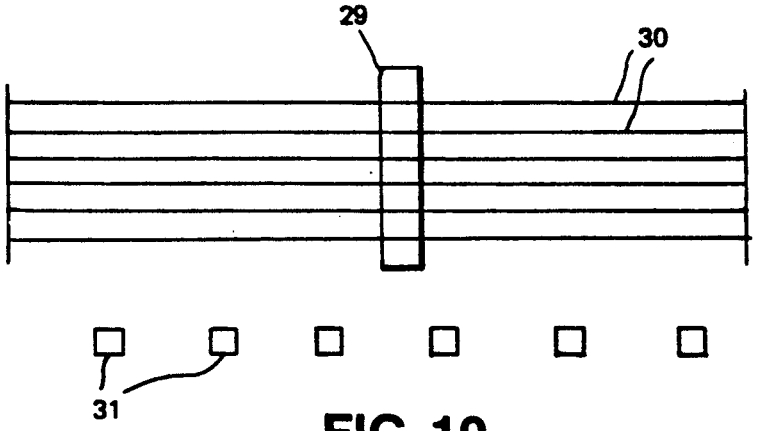
FIG. 10 shows a third type of plucking system for an instrument according to the invention; and, FIG. 11 shows the front panel of a control box for use with the guitar-style synthesizer-controller of this invention.

FIG. 10 illustrates a third type of possible plucking system. A magnetic or piezo-electric guitar pick-up 29 is used together with short steel strings 30, which do not need to be tuned and are located in the pluck area of the guitar. A pluck envelope is produced, when a note is plucked, which is converted into a digital signal and transmitted via the M.I.D.I. The signal would normally be assigned to attack or velocity.

According to the invention the pluck sensing means such as the position touch-sensitive switches are an important feature of the invention. They allow different pre-set timbres to be played, depending on which switch is selected upon plucking.

Figure 11:
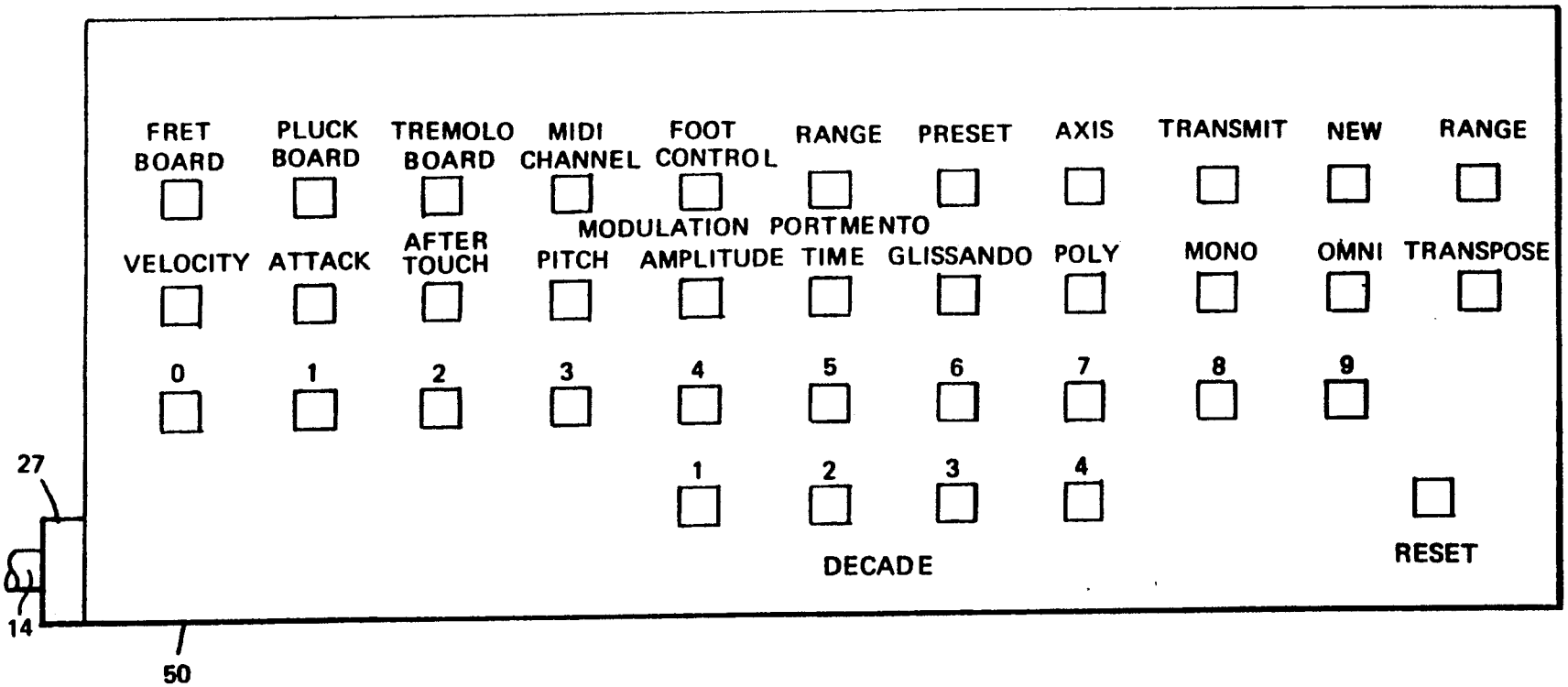

FIG. 11 illustrates the front panel of the M.I.D.I. control box 50. It consists of a metal box containing control electronics. Electrical connections are made to the instrument via the multicore connector 27 and the multicore cable 14. Standard M.I.D.I. connectors are provided at the rear of the box for the transmission of M.I.D.I. signals. Touch switches are provided on the front panel for patch selection. Each switch has an integral or adjacent bi-colour light emitting diode.

For instance, the diode will be off when a function is not selected, red for an error selection and another colour, e.g. yellow, for selected. If a set-up is new, the new switch is selected first. To abort any set-up the reset switch is selected. If it is to be stored as a pre-set, the pre-set button is selected followed by the pre-set number on the data switches (bottom two rows). The item to be set up is selected next (top row) followed by its number and/or axis on the data switches. If axis is not selected, axis 1 will be assumed. The parameter is selected next by selecting the appropriate parameter switch (second row). The range is then set by selecting the range switch followed by a value on the data switches. For data values higher than 9, the appropriate decade switch should be selected first, followed by the appropriate digit on the upper row. The M.I.D.I. channel is then selected with the M.I.D.I. channel switch followed by a number on the range switches. To transmit the patch via the M.I.D.I. the transmit switch is then selected. The patch is stored in a non-volatile RAM memory. A floppy disc drive unit could be included in the control box to enable patch data to be stored on floppy disc. When a pre-set is selected on the instrument, all information set-up and stored for that pre-set number will be transmitted via the M.I.D.I.

In the foregoing description there is described how one can produce multi-timbre chords or notes and pitch bend actions simulating the performance of a guitar.

A modified multi-timbre system can alternatively be used.

When the "arm multi-timbre" function is selected by switch, the timbre played will depend on the area of the arm on which the notes are selected. Notes selected on open fret to fret 4 on every string position would play a timbre different to notes selected on frets 5 to 9. The frets could be divided in other combinations. Other divisions could be made between string positions. Higher fret sections are divided in the same way, each section being used to play a different timbre. A hold switch can be selected for each combination to prevent note-off signals from being transmitted until an adjacent reset switch is selected or until new notes are selected on that section of frets. Alternatively, a master hold switch could be used for the combination being used at the time it is selected. The lowest fret on each timbre section, on each string position, could be played as an open string note when the "multi open-string" switch is selected.

It may finally be noted that although the invention as described concerns electronic musical simulation and synthesization, the guitar-style synthesizer-controller may be used in combination with or may incorporate conventional guitar strings. The invention also includes double-neck guitars.

I claim:

1. A guitar-style synthesizer-controller comprising a body having a playing face with a pluck or strum region having an array of individual pluck-sensitive means for sensing a plucking motion to generate notes, an arm attached to the body and carrying a plurality of elongate lines of frets spaced alternatively with note-selection for selecting means, switch means adjacent to said pluck-sensitive means, said frets and said note-selection means for controlling note parameters an interface which is arranged to produce digital output signals, wherein the frets and note-selection means are resiliently displaceable in at least one direction and displacement sensing means are associated therewith to provide output signals representative of such movement, and wherein the pluck-sensitive means are mounted on pluck boards, each of which boards is resiliently movable in at least one direction with displacement means associated therewith to provide output signals representative of such movement.

2. A synthesizer-controller as claimed in claim 1, in which the frets and note-selection means are mounted on a plurality of parallel fret boards which are each resiliently displaceable about three mutually perpendicular axes.

3. A synthesizer-controller as claimed in claim 1, which includes individual touch-sensitive switches associated with each fret and each note-selection means.

4. A synthesizer-controller as claimed in claim 1, in which output signals representative of displacement movement of the frets and note-selection means are assigned to pitch bend.

5. A synthesizer-controller as claimed in claim 1, in which the pluck-sensitive means comprise touch-sensitive switches.

6. A synthesizer-controller as claimed in claim 1, in which the displacement sensing means comprises magnets and Hall-effect devices.

7. A synthesizer-controller as claimed in claim 1, in which output signals representative of displacement movement of the pluck boards are used to control velocity signals.

8. A synthesizer-controller as claimed in claim 1, said pluck-sensitive means include means for selecting a plurality of timbres to be played simultaneously.

9. A synthesizer-controller as claimed in claim 1, in which the pluck or strum region includes a plurality of tremolo boards each adapted to add tremolo to notes plucked on the adjacent said pluck board.

10. A synthesizer-controller as claimed in claim 1, in which a tremolo board is provided adjacent to each pluck board to add tremolo to notes plucked on the adjacent pluck board and has a touch-sensitive switch associated therewith, with each associated pluck board and tremolo board pair being resiliently relatively movable towards and away from each other to generate an output signal.

11. A synthesizer-controller as claimed in claim 1, which includes hold switches in the pluck of strum region to prevent note-off signals from being transmitted from the interface and enabling a plucked note to be sustained after it has been released on a fret board carrying the frets and the note-selection means.

12. A synthesizer-controller as claimed in claim 1, which includes means located on the arm to permit adjacent of pitch bend sensitivity.

13. A synthesizer-controller as claimed in claim 1, which includes touch-sensitive switches to permit adjustment of pluck sustain.

14. A synthesizer-controller as claimed in claim 2, which includes an open-string circuit associated with each fret board, said open-string circuit including a switch movable between a mute position and a play position.

15. A synthesizer-controller as claimed in claim 1, in which the pluck-sensitive means comprises an array of photo-sensors or photo-switches.

16. A synthesizer-controller as claimed in claim 1, in which the pluck-sensitive means comprises a magnetic or piezoelectric pick-up for use with metal strings located in the pluck or strum region.

17. A synthesizer-controller as claimed in claim 1, in which the frets are divided in preset combinations so that frets in different sections of the linear array of frets produce different timbres.

18. A synthesizer-controller as claimed in claim 3, in which each touch-sensitive switch comprises a CMOS logic circuit with a Zener diode protecting the CMOS device, with the Zener voltage being lower than the supply voltage of the circuit between the circuit input and ground.

19. A synthesizer-controller as claimed in claim 5, in which each touch-sensitive switch comprises a CMOS logic circuit with a Zener diode protecting the CMOS device, with the Zener voltage being lower than the supply voltage of the circuit between the circuit input and ground.

* * * * *